US006551137B2

(12) United States Patent
Pfaff et al.

(10) Patent No.: US 6,551,137 B2
(45) **Date of Patent: *Apr. 22, 2003**

(54) ELECTRICAL CONNECTOR PLUG FOR IGNITION DEVICES

(75) Inventors: Matthias Pfaff, Offenbach/M (DE); Klaus Rieger, Igensdorf (DE)

(73) Assignee: Framatome Connectors International, Courbevoie (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/434,612

(22) Filed: Nov. 5, 1999

(65) Prior Publication Data

US 2002/0068480 A1 Jun. 6, 2002

(30) Foreign Application Priority Data

Nov. 6, 1998 (DE) ..... 198 51 301

(51) Int. Cl.[7] ..... H01R 13/648
(52) U.S. Cl. ..... 439/607; 439/289
(58) Field of Search ..... 439/610, 607, 439/609, 352, 188, 488, 489, 289

(56) References Cited

U.S. PATENT DOCUMENTS 4,306,499 A 12/1981 Holmes ..... 102/202.4
4,720,155 A 1/1988 Schildkraut et al. ..... 439/108
5,022,871 A 6/1991 Sekiguchi ..... 439/609
5,586,902 A * 12/1996 Hopf et al. ..... 439/352
5,609,498 A * 3/1997 Muzslay ..... 439/352
5,613,865 A * 3/1997 Dullin et al. ..... 439/188
5,616,045 A * 4/1997 Gauker ..... 439/352
5,816,840 A * 10/1998 Dullin ..... 439/352
5,971,789 A * 10/1999 Sukegawa ..... 439/352

FOREIGN PATENT DOCUMENTS

DE 198 04 624 A1 8/1998
EP 0 591 947 A2 4/1994

* cited by examiner

*Primary Examiner*—Tho D. Ta
*Assistant Examiner*—Edwin A. León
(74) *Attorney, Agent, or Firm*—Perman & Green, LLP

(57) ABSTRACT

The invention concerns an electrical plug connector with a shielding device (8) which comprises a housing (1) and a plug-in projection (2) mold onto the housing (1) which includes along the plugging-in direction of the plug connector, contact elements (5) for engaging with corresponding counterparts (32) in a connector part (30) and at least one guide element (7) for engaging with a complementary piece (31), where the shielding device (8) comprises an electrically conductive ring (10) which surrounds the contact elements (5) and contact studs (11) for conducting away electrical charges on the connector part (30).

12 Claims, 5 Drawing Sheets

ELECTRICAL CONNECTOR PLUG FOR IGNITION DEVICES

BACKGROUND OF THE INVENTION

1. Field of the Invention

The present invention is relating to an electrical connector plug for ignition devices including a housing and a plug-in projection mold onto the housing in combination with a shielding device. Such plugs find particular application for airbag restraint systems in motor vehicles.

In airbag restraint systems, the plug connector with its plug-in projection is plugged onto a corresponding counterpart which is located on the housing of the ignition device of the airbag. The ignition device, the impact bag as well as the electrical leads are located on the driver's side in the impact plate of the steering wheel. Furthermore, the electrical connection of the ignition device forms, together with the control system, a very sensitive place of the restraint system, since uncontrolled potential fluctuations which occur on the electrodes of the ignition device may lead to an unscheduled release of the airbag.

2. Description of the Prior Art

The U.S. Pat. No. 4,306,499, describes a plug connector with non-massed junctions. In order to provide a shield from electrostatic energy, an ignition initiator is fitted with a shield socket which surrounds an ignition unit, so that electrostatic energy received from the socket which is connected to the ignition unit is passed to the shield socket via a spark discharge. This prevents an uncontrolled triggering of the ignition device via electrostatic energy This construction has the drawback that the ignition distance between the two sockets of the ignition device must be very carefully adhered to, which makes this the requirement placed on the process of manufacture of the two shells a very stringent one and this fact, in turn, is responsible for a very high cost of the ignition device as a whole. Furthermore, neither the electrical junctions of the ignition device, nor the electrical junctions of the plug connector are protected in any way. Thus, the ignition device or the plug connector can be electrostatically charged so that during the process of plugging in the electrostatic energy is sufficient to trigger the ignition device.

For this reason, known plug connectors have plug-in pins in their plug-in sockets which are plugged onto plug pins and the plug-in projection separates a shorting bar between the plug pins of the ignition device from the latter when the contact for the plug-in sockets already exists.

The said shorting bar effectively prevents the unscheduled triggering of the ignition device by electrostatic energy during the process of plugging-in.

The patent EP 0 591 947 describes a plug connector equipped with such a shorting bar which is so constructed that the shorting bar is arranged in an additional restraint.

SUMMARY OF THE INVENTION

This construction has the drawback that the plug connector now consists of three parts, to wit, the plug connector itself, the complementary matching plug-in counterpart and the restraint with a shorting bar. This increases costs as well as prolongs the time needed for carrying out the construction.

In both cases, the ignition devices are triggered via a control unit, where the ignition devices exhibit no "intelligence", that is to say, they do not incorporate any control electronics. Therefore, a current is sent by the electronic control center to the ignition device, causing the latter to ignite.

The plug connectors which are here presented are not suitable for the linking of peripherals such as airbag igniters to the newly introduced bus systems which have recently been introduced into vehicle technology.

The present invention has the goal of connecting the ignition device carrier of the ignition device to mass immediately on being plugged in, even before the electrical pins of the ignition device and the electrical plug-in sockets of the plug connector have made electrical contact. Furthermore, the plug-in part of the plug connector should be protected from acquiring an electrostatic charge or from electromagnetic interference.

This goal is achieved by an electrical plug connector including a housing an a plug-in projection mold onto the housing which comprise along the plug-in direction of the plug connector contact elements for mating by a mating face with corresponding counter elements in a connector part wherein a shielding device includes an electrically conductive ring on the mating face which surrounds ends of the contact elements and with at least one connection which is connected to a cable in the plug connector.

The electrical plug connector fitted with a shielding device may exhibit a housing. Furthermore, a plug-in projection may be provided on the housing, which may exhibit cells distributed along the plug-in direction of the plug connector, in which contact elements may be located. On the side of the plug-in projection can be arranged at least one stop spring element which may also be a stop spring arm, for clicking into at least one retainer provided in a corresponding connector part which is complementary to the plug-in projection. Further, a guide element for sliding into a complementary piece may be provided. Apart from this, the connector plug may exhibit a cover which matches the housing. The shielding device may have an electrically conducting ring connected to mass which surrounds the contact elements which exhibit contact studs distributed around the plug-in projection.

In the case of the said electrical connector plug, the fact that the shielding device surrounds the insertion projection like a Faraday cage and is integrated in the connector plug is particularly advantageous. It is a special feature of the shielding device that it is arranged on the plug-in projection in such a way that on being plugged into a metal ignition device carrier, the latter is automatically earthed.

DETAILED DESCRIPTION OF THE DRAWINGS

Various embodiments of the invention will now be more fully illustrated schematically by means of drawings. The figures which follow show the following aspects of the invention.

Figure 1B:
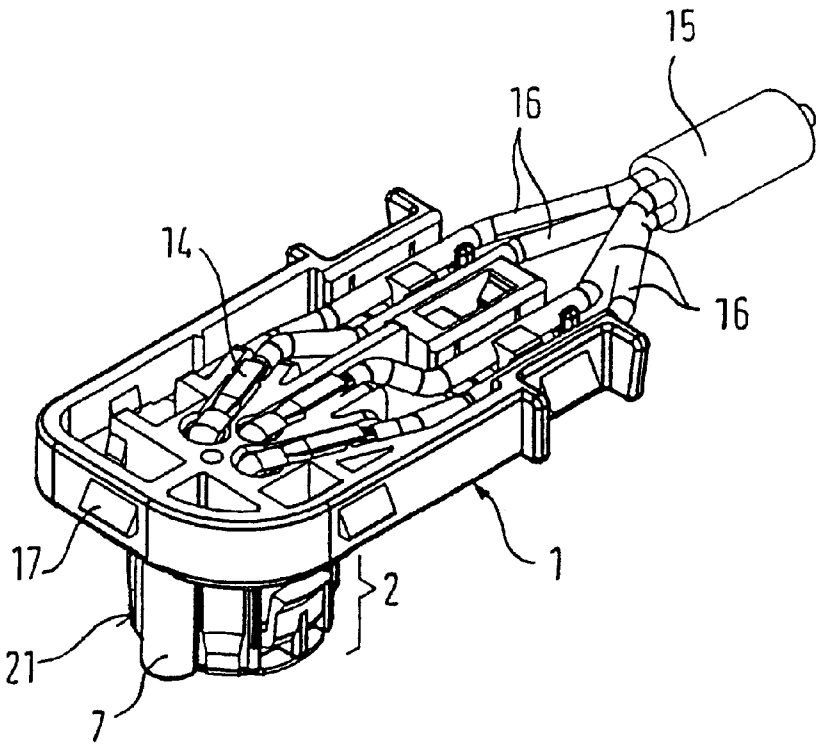
FIG. 1B shows a plug connector according to the invention without its cover looked at diagonally, where the plug connector from FIG. 1A has been rotated through 180° along its longitudinal axis.
Figure 1A:
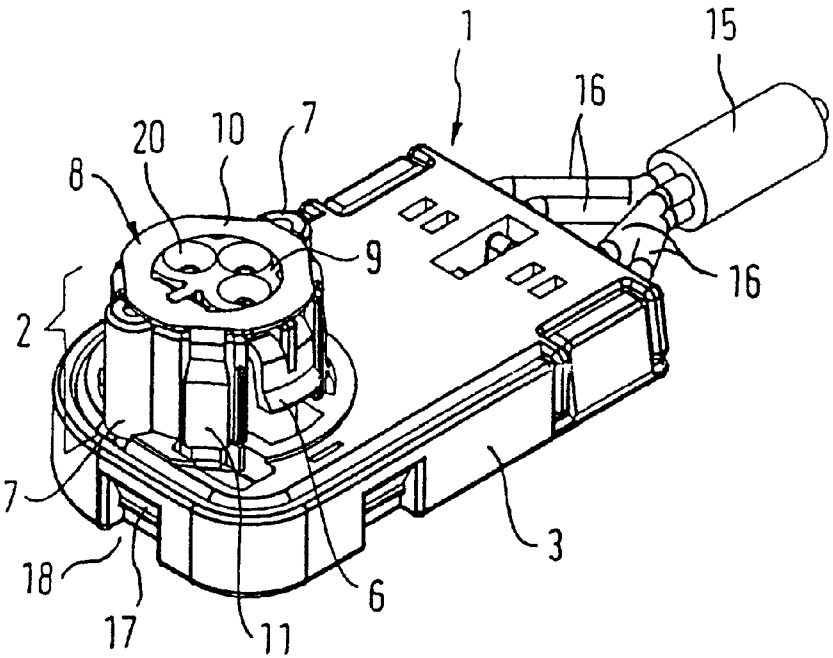
FIG. 1A shows a plug connector according to the invention looking diagonally at the plug-in projection
Figure 3B:
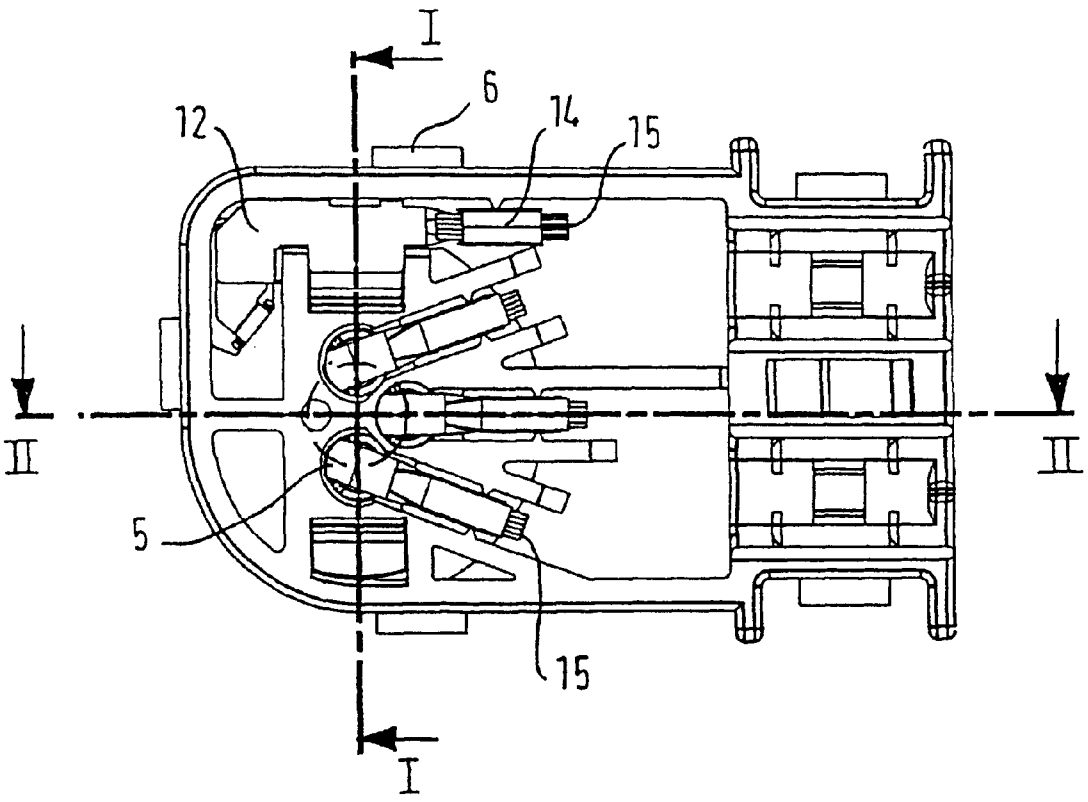
FIG. 3B shows a view of the reverse side of the opened-up plug connector
Figure 3A:
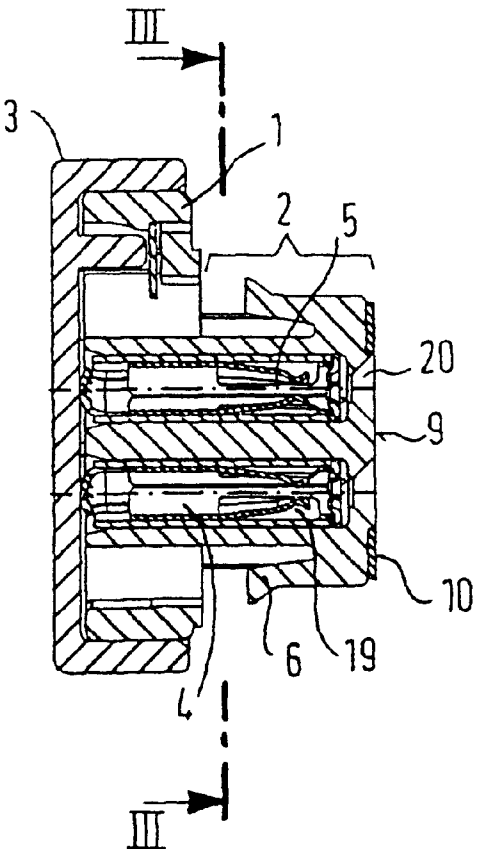
FIG. 3A shows a section along the line I—I of FIG. 3B.
Figure 5:
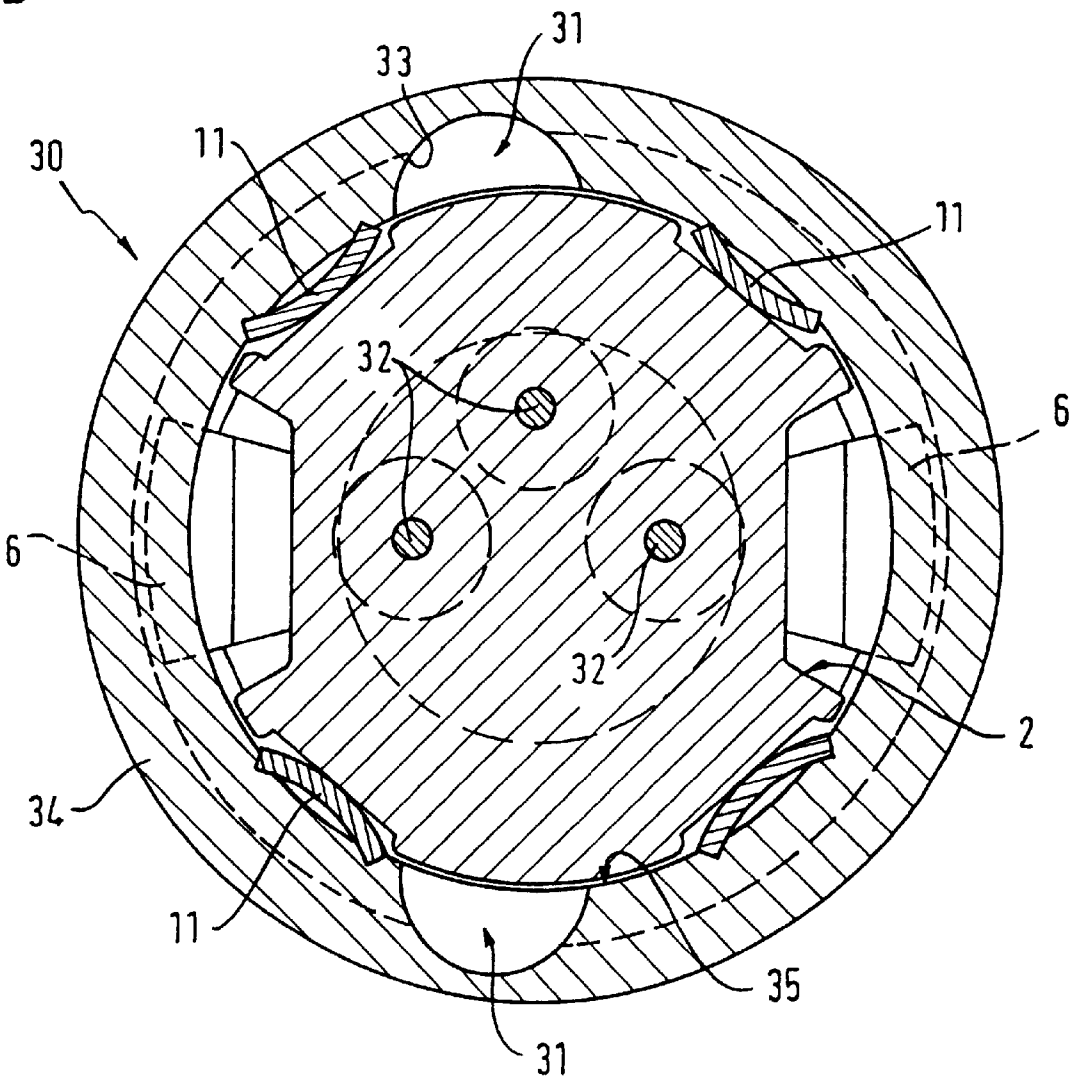

FIG. 5 is a highly schematic section of the plugged-in plug connector along the line III—III of FIG. 3A In FIGS. 1A and 1B, the plug connector according to the invention is seen both with and without its cover 3. The plug connector comprises a housing, a plug-in projection 2 and a cover 3. The housing is fitted with a stop keys 17 which are able to reach into the openings 18 of the cover 3 when they are interconnected, as shown in FIG. 1A. The plug-in projection 2 is substantially cylindrical in shape. The form of the plug-in projection can be elliptical, rectangular or square and the edges of the plug-in projection and the walls of the connector part assume the task of the guide element 7.

DESCRIPTION OF THE PREFERRED EMBODIMENTS

On the cylinder jacket of the plug-in projection 2 there are two guide elements 7 which are mold over the entire height of the plug-in projection 2. These guide elements 7 are also employed as coding keys, in order to forestall any confusion as between similar plug connectors. Similar plug connectors are identical, except for the arrangement of the guide elements 7. Also on the cylinder jacket 21 are mold-on in diametrically opposed positions two elastic stop spring arms. These are able to snap into retainers which are provided in a connector part which is complementary to the plug-in projection. An ignition device carrier (see FIG. 5) of an airbag ignition device may be regarded as being one of the connector parts. The closing surface 9 of the plug-in projection 2 comprises passages 20 to the cells 4 and also the ring 10 of the shielding device 8 which surrounds the passages 20 to the cells 4. On this ring 10 are mold contact studs which are arranged along the plug-in projection 2. The central points of the vaults are external to the plug-in projection 2.

In FIG. 1B, the cabling of the plug connector can clearly be seen. One the one hand, the plug connector has 3 junctions which lead to a system bus and on the other hand an mass which is connected to the vehicle mass. This mass is electrically connected to the shield 8.

Figure 2:
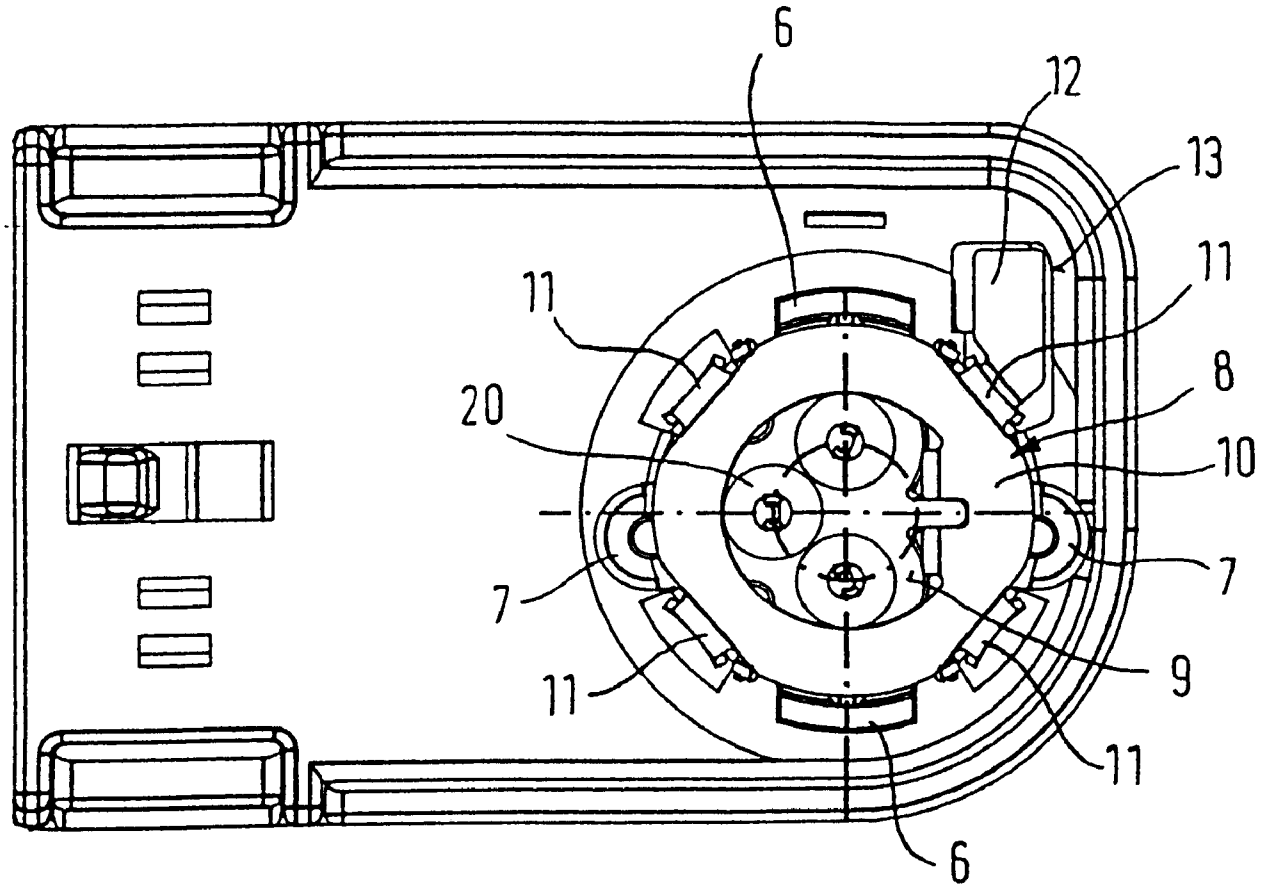
FIG. 2 shows a plan view of the plug connector according to the invention.

FIG. 2 shows a plan view of the plug connector, where the connection of the shield 8 can clearly be seen. One of the contact studs 11 of the shield 8 is extended by means of a contact element 12 which passes through one of the openings 13 of the housing 1 and then passes into the housing interior into a crimp connection 14, to which is crimped a wire 15 (see FIG. 3B) which leads to the vehicle mass. In this figure, the vaults of the contact studs 11 can clearly be seen, with the edges of the contact studs bent away from the plug-in projection.

FIG. 3B shows a plan view of the reverse side of the plug connector. The section along the line I—I (FIG. 3A) is also seen in FIG. 3A. On the right hand side of FIG. 3A can be seen the ring 10 and also, both above and below the plug-in projection 2, the stop spring arms 6. Since the section runs along the plug-in direction of the plug connector and passes through the cells 4, the plug sockets can easily be seen. These exhibit a narrowing 19 in the right hand side area of FIG. 3A; this narrowing enables them to make better contact with the plug-in pins of the ignition device carrier. To make the introduction of the plug connector easier, the passages 20 to the cells 4 are widened in an outward direction.

Figure 4:
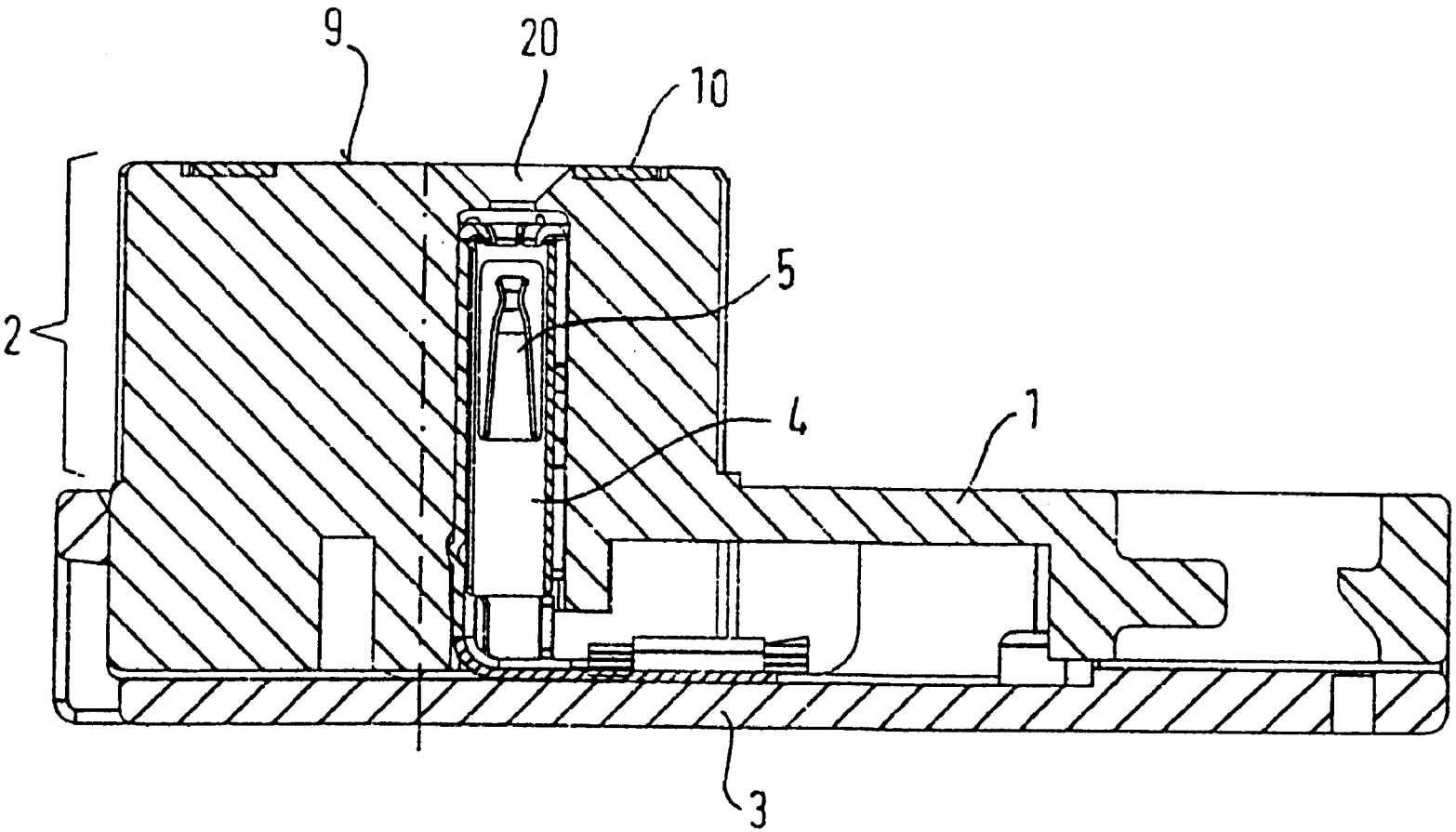
FIG. 4 shows a section along the line II—II of FIG. 3B

FIG. 4 shows a section along the line II—II of FIG. 3B. This figure shows in particular how the plug-in socket 5 passes to the crimp connection. To simplify the diagram, the strands 15 (see FIG. 3B) of the cable have only been shown partially.

FIG. 5 shows a section of a plugged-in plug connector along the line III—III which is shown in FIG. 3A.

The connector part 30 which can in particular be an ignition device carrier of an airbag ignition device, comprises a conducting housing 34 with slots 31 for the retention of guide elements, a first retainer 33 for engaging the stop spring arms and a second retainer 35 for the plugging-in of a plug-in projection. Further, the floor of the housing 34 comprises contact pins 32 in the direction of insertion, the contact pins being electrically insulated from the housing 34. The second retainer 35 is essentially circular in shape, to match the plug-in projection 2.

The first retainer 33 is fitted into the side wall of the housing 34 in such a way that on the one hand the first retainer 33 covers the entire circumference and on the other hand is open towards the second retainer 34.

The respective distances between the housing floor and the first retainer and the distance between the closing surface 9 and the stop lug 22 are identical. To simplify the diagram, FIG. 5 shows only the plug-in projection 2, the stop spring arms 6 and the contact studs 11. It can be seen particularly clearly, how the contact studs 11 penetrate into the ignition device carrier and how the stop spring arms are in the engaged position.

Hereinafter follows only one embodiment example of the plug connector according to the invention.

This plug connector with a shielding device is employed in particular as a plug connection for bus systems. In contrast to the cited state-of-the-art it must be stated that the actual information concerning the triggering of the ignition device is sent out in a coded form. According to the state-of-the-art, a current impulse is sent by the control system to the plug connector which triggers the ignition device. The "intelligence" of the control system is apportioned, that is to say, the ignition device carrier of the ignition device receives its own logic.

So that the ignition device may be triggered, the control system only needs to send a digital signal with the address of the ignition device via the bus and the logic of the ignition carrier then evaluates the signal and carries out a corresponding procedure in order to ignite the ignition device. The fact that in order to ignite the ignition device a certain coding is required is advantageous so that a signal from interference is generally insufficient to trigger the ignition device. It has transpired that it is advantageous to lead the mass of the vehicle separately from the mass of the bus. This causes one of the junctions of the plug connector to act as the bus mass, whilst the other two represent the entry and exit junctions of the bus.

When the plug connector according to the invention is plugged into its matching conducting ignition carrier, the contact studs 11 of the screen 8 penetrate into the housing 34 of the ignition device carrier. In a fully plugged-in condition, the stop spring arms 6 snap into the slots 3. The making of this contact serves to protect from electrostatic charge which is passed to the vehicle mass. Otherwise, the said electrostatic charges would be carried by the ignition device. Since the contact studs penetrate into the surface of the ignition device carrier, a plugged-in connection is created which it is difficult to break and which cannot easily be loosened by vibrations.

What is claimed is:

1. An electrical plug connector comprising:

a housing and a plug-in projection mold onto the housing which comprises along a plug-in direction of plug connector contact elements for mating by a mating face with corresponding counter elements in a connector part wherein a shielding device comprises an electrically conductive ring on the mating face which surrounds ends of the contact elements and with at least one connection which is connected to a cable in the plug connector, the ring including contact studs arranged parallel to the plug-in direction, the studs adapted to conducting away electrical charges, the shielding device including projections forming the studs, such projections starting from a periphery of the ring being bent and lying on an external profile of a plug projection, in a direction parallel to the mating direction of the plug in a complementary connector recess.

2. An electrical plug connector according to claim 1, wherein said housing and a cover exhibit matching stop elements making said housing and the cover able to be plugged in.

3. An electrical plug connector according to claim 1, wherein said plug-in projection is substantially cylindrical in shape and at least one stop spring arm and one guide element are arranged on the outer circumference of said plug-in projection.

4. An electrical plug connector according to claim 1, wherein said plug connector is a plug connector for airbags.

5. An electrical plug connector according to claim 1 wherein said contact elements are plug sockets which are arranged inside cavities in said plug—in projection and the corresponding counterparts are contact pins, and furthermore that said ring is arranged on a front surface of said plug-in projection in a manner such that cavity openings are surrounded by said ring, said plug in projection being received in a complementary shaped recess of a complementary connector.

6. An electrical plug connector according to claim 1, wherein at least one of said contact studs is extended by means of a contact element which passes through an opening of said housing and which is electrically connected to said cable and which is located inside said plug connector, at least one of said studs being extended by a contact finger extending inside said housing through a hole of said housing, such contact finger having a crimp connection section located in said housing such crimp connection section being connected to a ground wire.

7. An electrical plug connector according to claim 1, wherein at least one of said stud projections has arcuate sections forming sharp edges, such edges being shaped and having sufficient sharpness as to pierce into a metallic material in the sidewalls of the complementary connector recess.

8. An electrical plug connector according to claim 1 wherein at least one of said studs have a non-constant width in a direction perpendicular to the mating direction, such width increasing from in a direction opposite to said mating direction.

9. An electrical plug connector according to claim 1 wherein said shielding device comprises bent hooks said hooks directed towards said plug connector and biting in said plug connector in order to retain the shielding device onto said plug connector.

10. An electrical plug connector comprising:

a housing and a plug-in projection mold onto the housing which comprises along a plug-in direction of plug connector contact elements for mating by a mating face with corresponding counter elements in a connector part wherein a shielding device comprises an electrically conductive ring on the mating face which surrounds ends of the contact elements the ring includes contact studs arranged parallel to the plug-in direction, the studs adapted to conducting away electrical charges, and with at least one connection which is connected to a cable in the plug connector and wherein said plug-in projection is substantially cylindrical in shape and at least one stop spring arm and one guide element are arranged on the outer circumference of said plug-in projection, the shielding device projections forming the studs, such projections starting from the periphery of the ring being bent and lying on an external profile of a plug projection, in a direction parallel to the mating direction of the plug in a complementary connector recess.

11. An electrical plug connector according to claim 1, wherein at least one of said contact studs is extended by means of a contact element which passes through an opening of said housing and which is electrically connected to said cable and which is located inside said plug connector, at least one of said studs being extended by a contact finger extending inside said housing through a hole of said housing, such contact finger having a crimp connection section located in said housing such crimp connection section being connected to a ground wire.

12. An electrical plug connector according to claim 1, wherein at least one of said stud projections has arcuate sections forming sharp edges, such edges being shaped and having sufficient sharpness as to pierce into a metallic material in the sidewalls of the complementary connector recess.

* * * * *